US009056518B2

(12) United States Patent
Ishii

(10) Patent No.: US 9,056,518 B2
(45) Date of Patent: Jun. 16, 2015

(54) BALLPOINT PEN TIP, BALLPOINT PEN REFILL, AND BALLPOINT PEN

(75) Inventor: Yoshihide Ishii, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 376 days.

(21) Appl. No.: 13/583,473

(22) PCT Filed: Mar. 8, 2011

(86) PCT No.: PCT/JP2011/055305
§ 371 (c)(1),
(2), (4) Date: Sep. 7, 2012

(87) PCT Pub. No.: WO2011/111681
PCT Pub. Date: Sep. 15, 2011

(65) Prior Publication Data

US 2012/0328356 A1 Dec. 27, 2012

(30) Foreign Application Priority Data

Mar. 8, 2010 (JP) ..... 2010-050866

(51) Int. Cl.

| | |
|---|---|
| ***B43K 7/10*** | (2006.01) |
| ***B43K 1/08*** | (2006.01) |
| ***B43K 7/02*** | (2006.01) |
| ***B43K 15/00*** | (2006.01) |

(52) U.S. Cl.
CPC ..... *B43K 1/084* (2013.01); *B43K 1/086* (2013.01); *B43K 7/02* (2013.01); *B43K 7/10* (2013.01); *B43K 15/00* (2013.01)

(58) Field of Classification Search
CPC ..... B43K 1/084; B43K 1/086; B43K 7/10
USPC ..... 401/214–216
See application file for complete search history.

(56) References Cited

U.S. PATENT DOCUMENTS

| | | | | |
|---|---|---|---|---|
| 5,690,442 | A | 11/1997 | Sato et al. | |
| 6,082,920 | A * | 7/2000 | Furukawa | 401/216 |
| 6,193,429 | B1 * | 2/2001 | Kim | 401/214 |

(Continued)

FOREIGN PATENT DOCUMENTS

| | | | |
|---|---|---|---|
| JP | 8-207482 | A | 8/1996 |
| JP | 2000-158869 | A | 6/2000 |
| JP | 2000-158870 | A | 6/2000 |
| JP | 2002-052884 | A | 2/2002 |

(Continued)

OTHER PUBLICATIONS

International Search Report for PCT/JP2011/055305, mailing date of Apr. 5, 2011.

*Primary Examiner* — Jennifer C Chiang
(74) *Attorney, Agent, or Firm* — Westerman, Hattori, Daniels & Adrian, LLP

(57) ABSTRACT

A ballpoint pen tip in which ink grooves are formed around an ink guide hole at equally distributed places, the ink guide hole connecting a ball house and a back hole of a holder for holding the writing ball, and the ink grooves radially penetrate through from the ball house side to the front end portion of the back hole. Inward protrusions are formed at positions which are respectively in contact with the rear ends of the ink grooves. If the inner diameter of the ink guide hole is A, the inner diameter of the front end portion of the back hole is B, the diameter of the circle circumscribing the ink grooves is C, and the diameter of the circle inscribing the inward protrusions is D, their relationships are A<B<C, and D<B.

4 Claims, 7 Drawing Sheets

(56) References Cited

U.S. PATENT DOCUMENTS

| | | | | |
|---|---|---|---|---|
| 6,887,008 | B2 * | 5/2005 | Kitao et al. | 401/219 |
| 7,862,249 | B2 * | 1/2011 | Ohashi et al. | 401/216 |
| 2006/0115318 | A1 * | 6/2006 | Santini et al. | 401/214 |

FOREIGN PATENT DOCUMENTS

| | | | |
|---|---|---|---|
| JP | 2002-356083 | A | 12/2002 |
| JP | 2005-313401 | A | 11/2005 |
| JP | 2007-030374 | A | 2/2007 |

* cited by examiner

BALLPOINT PEN TIP, BALLPOINT PEN REFILL, AND BALLPOINT PEN

TECHNICAL FIELD

The present invention relates to a ballpoint pen tip and particularly relates to a ballpoint pen tip which allows sufficient ink supply to a ball even if an ink with high viscosity in a resting state is used and further prevents the risk of an ink drop.

BACKGROUND ART

In conventional ballpoint pens, ballpoint pens for allowing an outflow of various kinds of inks have been disclosed in recent years. Among those ballpoint pens, a ballpoint pen using an ink containing metal particles or having pigment fine particles whose diameter is large particularly in an ink with a shear-thinning property tends to have poor ink outflow characteristics in comparison with a ballpoint pen using an ink of normal colors such as black, red and blue. Therefore, as a measure taken against the above problems, a prior art is disclosed in Patent Document 1. The prior art is to ensure an ink flow rate by expanding the width of a plurality of ink grooves formed at equal intervals around an ink guide hole positioned in an axial center of a ballpoint pen tip.

Meanwhile, in recent years, as a measure taken against an ink drop in retractable ballpoint pens and a measure taken against a faint written trace in writing caused by vibration and impact to a penholder, a spring has been often inserted in a ballpoint pen tip to constantly bias a writing ball forward. Such a spring is usually formed by turning a tip-end part of a helical spring into a straight rod shape so that the tip is used to press a rear end of the writing ball. Such a spring has been regarded as inappropriate for use in such a case as, for example, the invention according to Patent Document 1 because the width of ink grooves is so wide that the rod part may stuck in the ink grooves.

Therefore, if such a spring is employed in a ballpoint pen tip, as shown in the invention according to Patent Document 2, it is necessary to create ink grooves up to the halfway of an ink guide hole and restrict a tip-end part of the spring by an inner diameter of the rear end part of the ink guide hole in order to prevent the spring from being stuck in the ink grooves.

CITATION LIST

Patent Documents

Patent Document 1: JP 2002-52884 A
Patent Document 2: JP 2000-158869 A

SUMMARY OF INVENTION

Technical Problem

However, the shape of the ballpoint pen tip according to Patent Document 2 makes it impossible to obtain a sufficient ink flow rate with the use of an ink with high viscosity. It is because such a shape allows an ink coming from the rear of a ballpoint pen tip to flow to a tip-end by passing through only an ink guide hole in which a tip-end part of the spring is present, whereby an effective sectional area of the ink guide hole is diminished by a wire diameter of the spring. Therefore, it was extremely difficult to manufacture a ballpoint pen tip which requires an ink flow rate while installing a spring therein to bias a wiring ball forward.

Accordingly, the present invention has an object to provide a ballpoint pen tip which neither causes, even if an ink with poor outflow characteristics is used, a faint written trace and an ink drop, nor impairs ink outflow characteristics.

Means to Solve the Problem

In the light of the above problems, the present invention relates to a ballpoint pen tip that comprises a writing ball and a holder holding the writing ball at its tip-end, wherein:

a tapered portion is formed to be tapered in a tip-end part of an outer periphery of the holder, a narrowed portion is formed to hold the writing ball by a tip-end of the tapered portion being deformed plastically inward, a ball house is formed as an inner space of the holder at the tapered portion in which the writing ball is inserted, a back hole is formed as an inner space of the holder extending forward from a rear end of the holder to a vicinity of the ball house, an ink guide hole is formed as inner space of the holder connecting the back hole and the ball house, ink grooves are formed as grooves penetrating from the ball house to a tip-end part of the back hole in a radial manner at a plurality of positions around the ink guide hole with equal intervals, an elastic member that biases the writing ball forward is inserted in the back hole, a biasing portion that is a tip-end part of the elastic member and extends forward, passes through the ink guide hole, contacts a rear-end of the writing ball and biases it forward, and inward protrusions that protrude inward are formed at positions in contact with rear-ends of the ink grooves in the tip-end part of the back hole;

when an inner diameter of the ink guide hole is A, an inner diameter of the tip-end part of the back hole is B, a diameter of a circle circumscribing the ink grooves is C, and a diameter of a circle inscribing the inward protrusions is D, the relationships of $A<B<C$ and $D<B$ are satisfied.

The "holder" refers to a main body part excluding the "writing ball" from the ballpoint pen tip and can be formed by, for example, curving a "columnar member" made of metal such as stainless steel.

A portion formed to be tapered at the tip-end of the holder is referred to as the "tapered portion." For example, if the holder is formed by the metallic columnar member, the tapered portion is to be formed by the curving process. The "tip-end" here naturally refers to a writing point side of a ballpoint pen tip and an opposite side thereof is a "rear end." Note that the rear end side of the holder, though its shape is not particularly limited, can be curved to reduce an outer diameter thereof and formed into a portion which is directly inserted into an ink storage tube or is inserted into a joint or the like interposed between the rear end and the ink storage tube.

The "ball house" refers to a space formed from the tip-end side in an inner circumferential area of the tapered portion, in which the writing ball is inserted. If the holder is made of the metallic columnar member, the ball house is formed by the curving process from the tip-end. The writing ball inserted in the ball house is held by the "narrowed portion," which is a tip edge of the tapered portion that is narrowed inward, so as not to come off. An inner diameter of the ball house is preferably formed larger than a diameter of the writing ball.

The "back hole" is a center hole formed from the rear end of the holder to the vicinity of the ball house without reaching the ball house. If the holder is formed by the metallic columnar member, the back hole is formed by the curving process. Moreover, an inner diameter of the back hole is preferably reduced in a stepwise manner as approaching the ball house from the rear end of the holder.

The "ink guide hole" is a center hole connecting the back hole and the ball house with a smaller diameter than the back hole.

The "ink grooves" refer to grooves that are distributed at equal intervals around the ink guide hole with respect to the axial center and run along the axial direction. If the holder is formed by the metallic columnar member, the ink grooves are formed by the curving process using a broaching tool from a bottom surface of the ball house. Note that the ink grooves penetrate up to the tip-end part of the back hole. Therefore, ink guided to the tip-end of the back hole reaches the ball house via the ink grooves and the ink guide hole. The diameter (C) of the circle circumscribing the ink grooves is preferably formed less than the inner diameter of the ball house for processing stability. Furthermore, the diameter (C) of the circle circumscribing the ink grooves is preferably made larger than the diameter of the writing ball. Thus, it is possible to prevent the writing ball from blocking the ink grooves resulting from abrasion of the bottom surface of the ball house due to rotation of the writing ball in writing over a long distance. This can also contribute to the stability of ink outflow characteristics.

The "elastic member" is preferably a spring which can be configured without blocking the ink guide hole as much as possible, but it is not particularly limited as long as being a member such as rubber rod and damper which constantly presses the writing ball forward in a resting state. Note that, in retractable ballpoint pens whose writing point is constantly exposed to the external air, the elastic member is a necessary component in order to prevent an ink drop when a writing point is left in a downward direction. Of course, there is no problem to use such an elastic member in capped ballpoint pens in which a writing point is sealed by fitting a cap when not in use. Moreover, if an elastic member or particularly a spring is used in writing instruments which use an ink with a shear-thinning property, internal movement of the spring during writing generates a shearing force of ink, whereby achieving improvement of ink outflow characteristics.

The "biasing portion" formed at the tip of the elastic member penetrates the ink guide hole from the back hole so as to contact the rear end of the writing ball that is positioned in the ball house. Then, elasticity of the elastic member constantly bias the writing ball forward. The biasing portion can be formed into a rod shape or formed by reducing a diameter of the spring in its tip-end part.

The "inward protrusions" are protrusions formed to protrude inward in the tip-end part of the back hole and in positions in contact with rear ends of the ink grooves. Since the inward protrusions are arranged to correspond to the plurality of the ink grooves respectively, they are distributed in equal intervals with respect to the axial center in the same manner as the ink grooves. Inner circumferential surfaces of the inward protrusions are finished by the curving process or other processes as needed so as to have the inner diameter (D) which is less than the inner diameter (B) of the tip-end part of the back hole.

That is, the ink grooves have a penetration structure in an area of the ink guide hole which is an area before ink reaches the writing ball and exposed to a highest fluid resistance. The inner diameter (B) of the tip-end part of the back hole is set to be less than the diameter (C) of the circle circumscribing the ink grooves and to be more than the inner diameter (A) of the ink guide hole. The ink grooves are further processed up to the tip-end part of the back hole. Then, deformed parts generated in curving the ink grooves such as, for example, metal parts deformed as a result of having been curved and pushed to the rear end the ink grooves in curving the ink grooves, are used to form the inner protrusions.

According to the structure described above, when a tip-end of the biasing portion of the elastic member tilts to a direction where the ink groove exists, it contacts the inner peripheral surface of the inner protrusion before reaching the ink groove. Then, further movement to the direction of the ink grooves beyond the inner protrusions is prevented. Therefore, even if the ink grooves are designed to have a larger width than a diameter of the biasing portion of the elastic member, there is a structure to prevent the elastic member from being stuck in the ink grooves while allowing improvement of outflow characteristics of an ink with high static viscosity.

The size of the writing ball is not specifically defined in the form of the ballpoint pen tip but a remarkable effect can be exhibited especially with a relatively small ball diameter of 0.5 mm or less.

Note that no problem will arise with ink outflow characteristics if the number of the ink grooves is two or more, but three the ink grooves distributed widely at even intervals are particularly preferable.

Advantageous Effects of Invention

In the present invention as structured above, if the ink grooves are formed to have a width which is larger than a diameter of the biasing portion of the elastic member, a tip of the biasing portion which tilts toward the ink grooves contacts the inner protrusions prior to be stuck in the ink grooves. Therefore, the biasing portion of the elastic member is prevented from being stuck in the ink grooves. Moreover, owing to a small diameter difference between the tip-end part of the back hole and the ink guide hole, even if the ink grooves are processed to have a broad width for better ink outflow characteristics, deformation of the ink guide hole can be suppressed and the ink guide hole can be made shorter. Furthermore, a passage which threads its way through the inner protrusions and the grooves is formed to realize comprehensive reduction of an ink outflow resistance. Therefore, it is possible to provide a ballpoint pen tip which is capable of avoiding a faint written trace and an ink drop without impairing ink outflow characteristics even if an ink with poor ink outflow characteristics is used, as well as being capable of preventing defective writing caused by ink evaporation and blurring due to vibration applied to a pen body.

DESCRIPTION OF EMBODIMENTS

Embodiments of the present invention will be explained with reference to the drawings.

Figure 1:
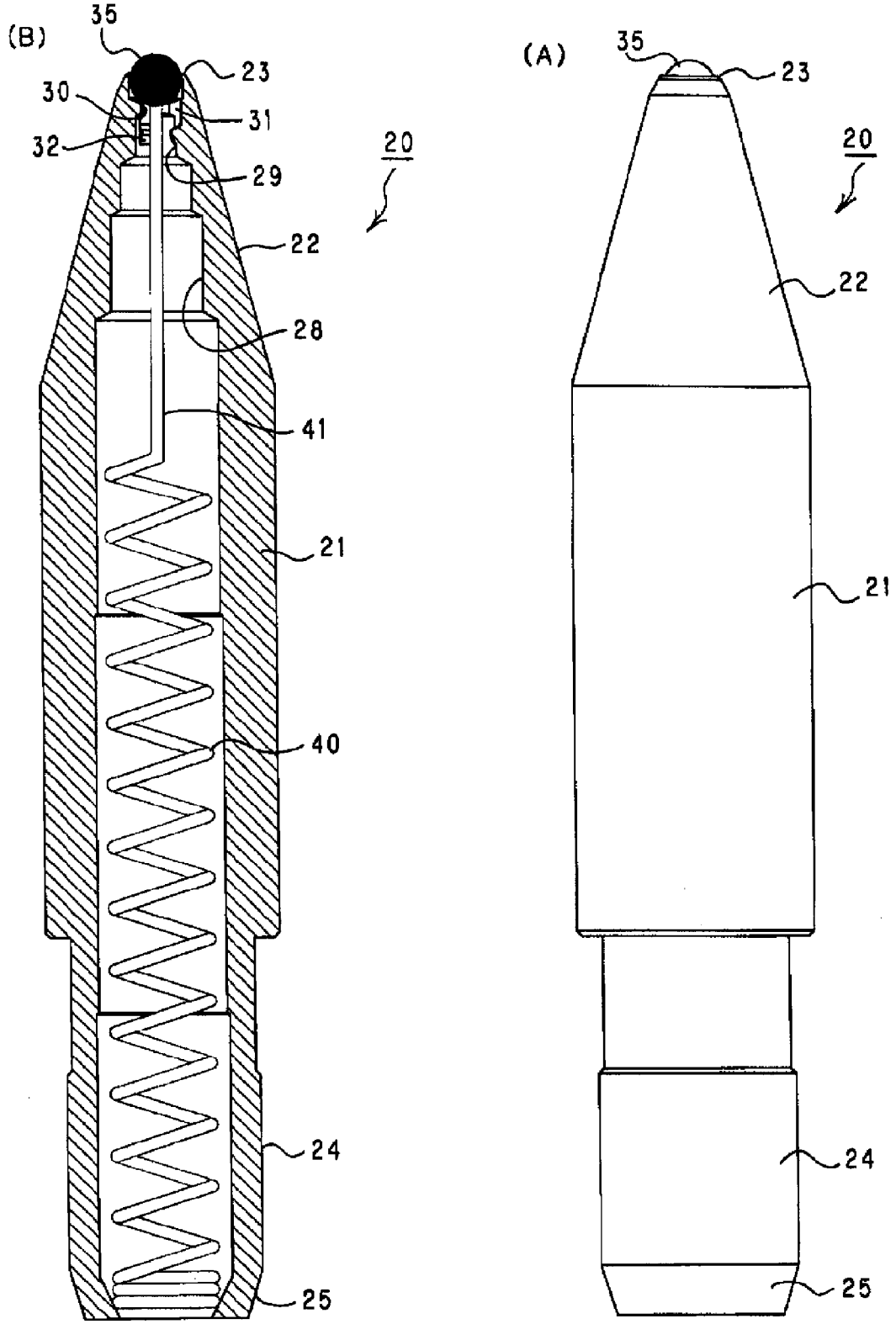
FIG. 1 A front view (A) and a front cross sectional view (B) of a ballpoint pen tip according to the present invention.

A ballpoint pen tip 20 according to the present embodiment is composed of, as shown in FIG. 1, a holder 21, a writing ball 35 held on a tip-end of the holder, and an elastic member 40 stored inside the holder.

The holder 21 is formed by curving a columnar member made of stainless steel. Its tip-end part is, as shown in FIG. 1(A), is tapered and curved into a substantially conical shape to create a tapered portion 22. On the other hand, a rear end part of the holder is formed as an inserted portion 24 whose outer diameter is reduced. This part is inserted into a joint 17 to be described later. Furthermore, a tip part of the writing ball 35, which is held inside the tapered portion 22, is exposed from a tip edge of the tapered portion and a tip edge of the tapered portion 22 is pressed inward and subjected to diameter contraction deformation to create a narrowed portion 23.

Next, with reference to FIGS. 1 to 8, a manufacturing process of the ballpoint pen tip 20 according to the present invention will be explained.

First, a tip-end side of a columnar member made of stainless steel is curved and tapered to create the tapered portion 22. Next, the inserted portion 24 is created by a curving process so as to reduce an outer diameter in the vicinity of a rear end of the holder 21 (see FIG. 1(A)).

Figure 2:
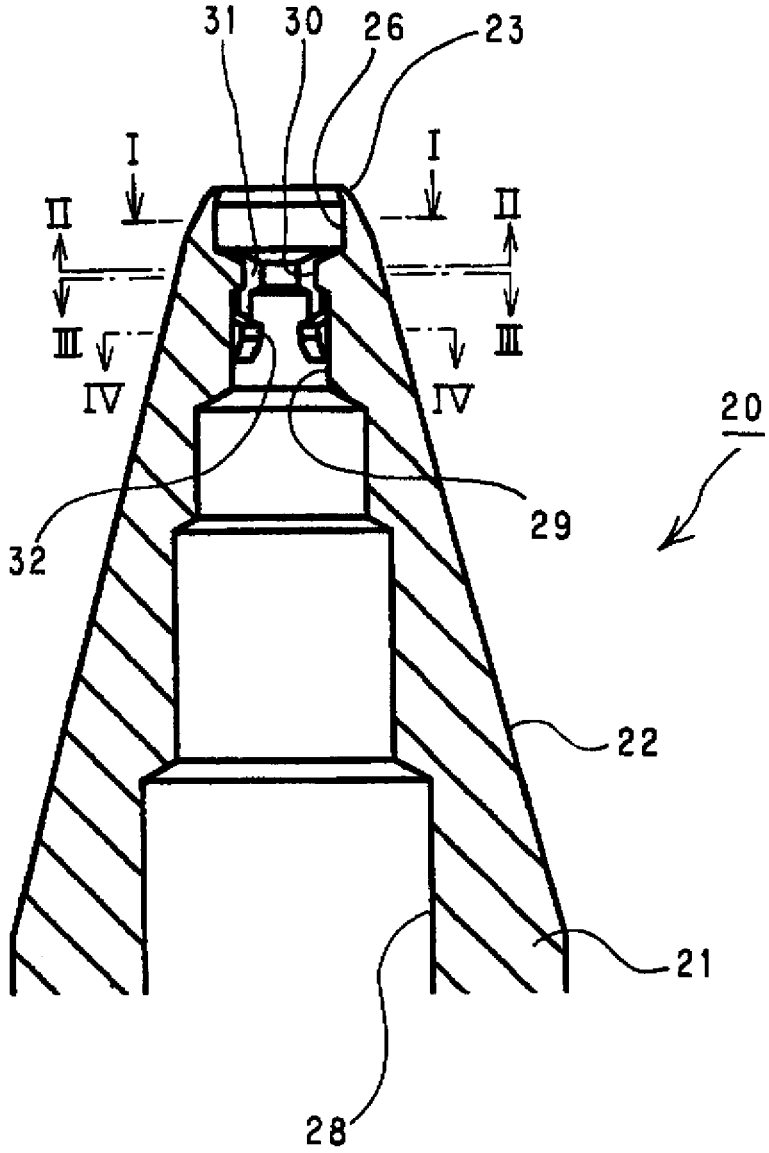
FIG. 2 A cross sectional view showing a tip-end part of a holder.
Figure 3:
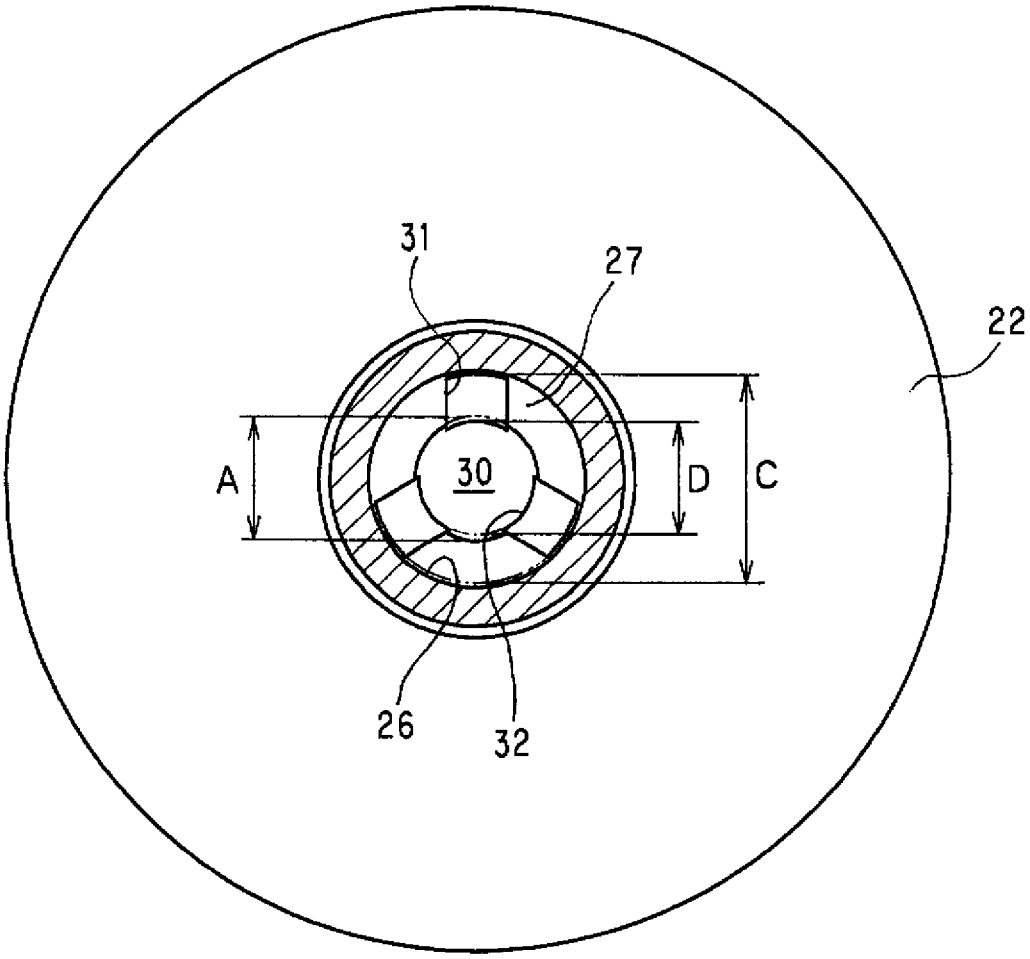
FIG. 3 A cross sectional view along I-I shown in FIG. 2.
Figure 4:
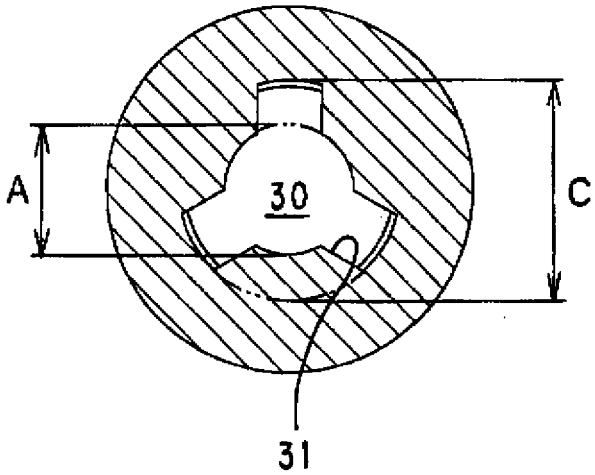
FIG. 4 A cross sectional view along II-II shown in FIG. 2.
Figure 5:
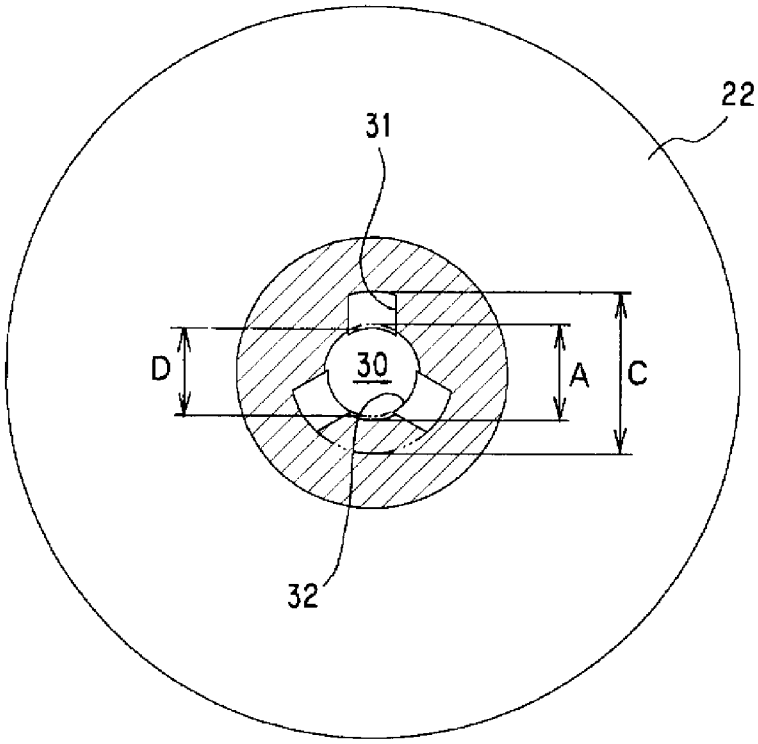
FIG. 5 A cross sectional view along shown in FIG. 2.

Then, from the rear end of the holder 21 to a middle part of the tapered portion 22, a back hole 28 is bored by reducing a diameter thereof in several steps (see FIG. 1(B) and FIG. 2). Next, an ink guide hole 30 is penetrated from the tip-end of the holder 21 to the back hole 28, followed by curving a ball house 26 from the tip-end of the holder 21 using a drill whose diameter is slightly larger than an outer diameter of the writing ball 35 (see FIG. 2). Subsequently, ink grooves 31 are created around the ink guide hole 30 from a bottom surface 27 of the ball house 26 by using a broaching tool (see FIGS. 3 and 8). As shown in FIG. 3 which shows a cross section along I-I in FIG. 2 and FIG. 4 which shows a cross section along II-II in FIG. 2, the ink grooves 31 here are so provided that three ink grooves 31 are radially distributed at equal intervals around the ink guide hole 30. The ink grooves 31 are penetrated up to a tip-end part 29 of the back hole 28 (see FIG. 2). Inward protrusions 32 are formed by smoothly curving the inner circumferences of portions protruding inward that are pressed and pushed rearward when the ink grooves 31 are formed, by using a drill (see FIG. 2). Here, as shown in FIGS. 3 and 5 which shows a cross section along III-III in FIG. 2, when the inward protrusions 32 are seen from the tip-end, they are visible behind the ink grooves 31. Moreover, as shown in FIG. 6 which shows a cross section along IV-IV in FIG. 2, the inward protrusions 32 are formed to protrude inward from the tip-end part 29 of the back hole 28.

Figure 6:
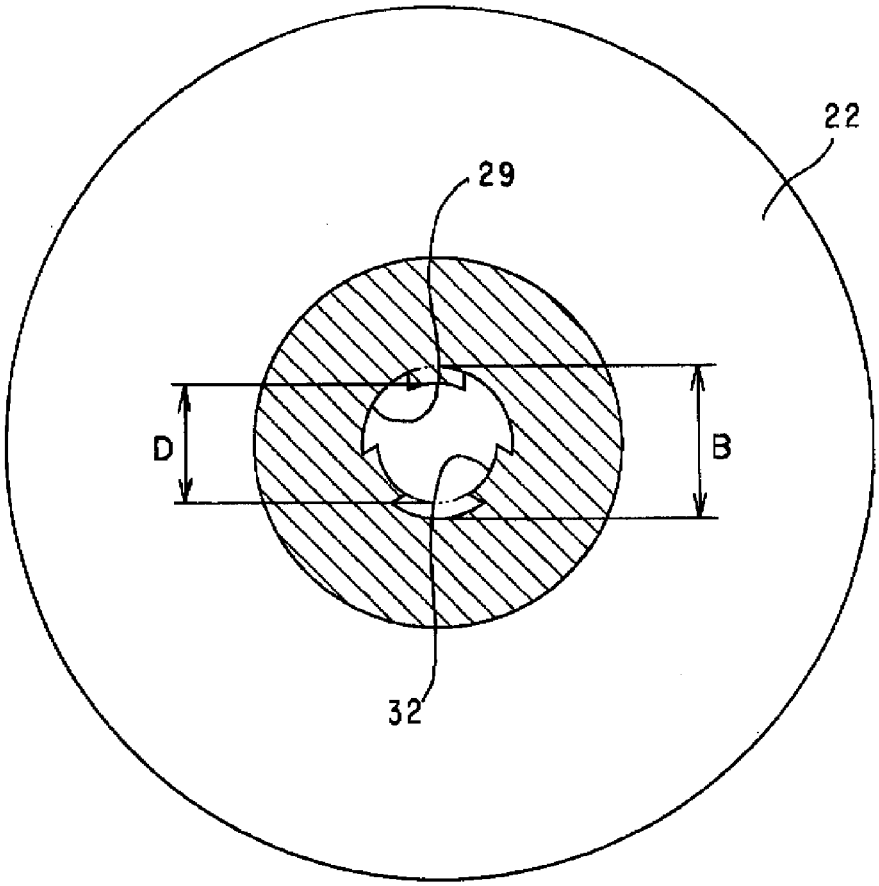
FIG. 6 A cross sectional view along IV-IV shown in FIG. 2.

Here, an inner diameter of the ink guide hole 30 is referred to as "A," an inner diameter of the tip-end part 29 of the back hole 28 "B," a diameter of a circle circumscribing the ink grooves 31 "C" and an inner diameter of an inner peripheral surface of the inward protrusions 32 "D." Then, the relationship D<A<C is fulfilled as shown in FIGS. 3 and 5, and D<B as shown in FIG. 6. Furthermore, in FIGS. 5 and 6, it is understood that the relationships A<B and B<C are obviously fulfilled from the comparison with D which is the same size in both figures. Therefore, from these figures, it is concluded that the relationships A<B<C and D<B are fulfilled.

Figure 7:
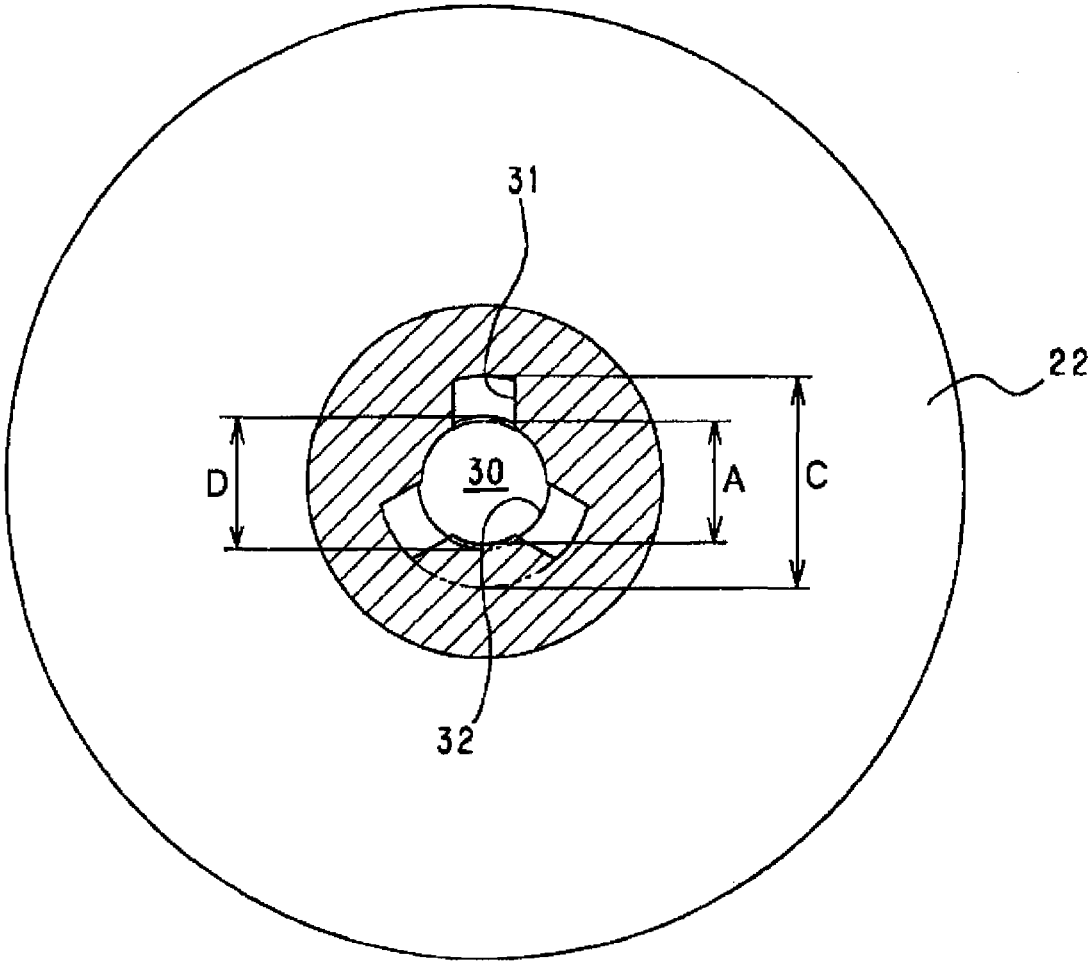
FIG. 7 An illustration showing a ballpoint pen tip according to another embodiment in light of the cross sectional view of FIG. 5.

Note that a case where A is larger than D as shown in FIG. 5 is an example and, for example, as shown in FIG. 7 which shows another embodiment, A may be smaller than D. When A is smaller than D, however, if a dimensional difference is too much, ink outflow becomes difficult and, therefore, it is preferable that A is nearly equal to B.

Then, the writing ball 35 which is made of cemented carbide is inserted into the ball house 26, followed by pressing and deforming the tip of the tapered portion 22 inward by a narrowing tool to create the narrowed portion 23 (See FIGS. 1(A) and (B)).

On the other hand, the elastic member 40 formed by a spring is inserted in the back hole 28. A tip part of the elastic member 40 is formed into a straight rod shape and this part is referred to as a biasing portion 41. A tip of the biasing portion 41 passes thorough the ink guide hole 30 and is brought in contact with a rear end of the writing ball 35 so as to press it forward. Note that a rear end of the holder 21 is partially deformed inward and this part serves as a fixing portion 25 to prevent the elastic member 40 from slipping off (see FIG. 1(B)).

Figure 8:
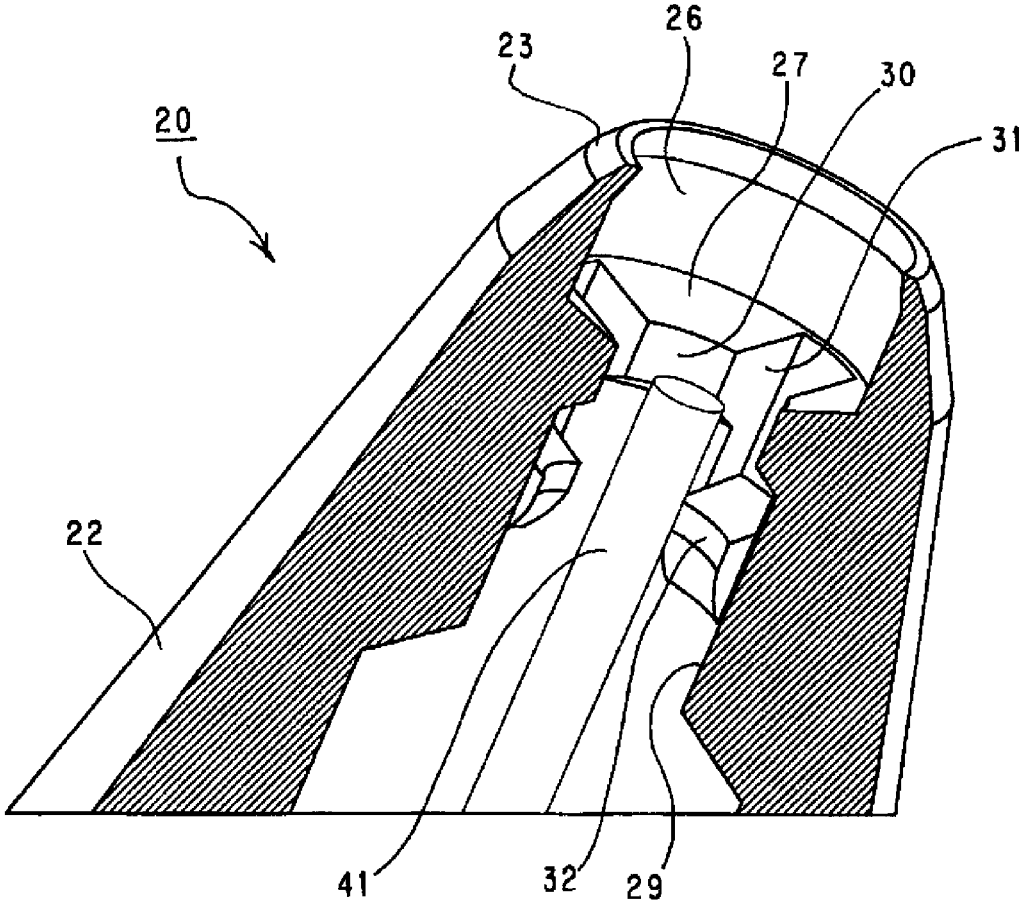
FIG. 8 A partial cross sectional view showing a state of the holder and an elastic member of the ball point pen tip according to the present invention, in which the writing ball is omitted.

In the ballpoint pen tip 20, as shown in FIG. 8, if the biasing portion 41 at the tip of the elastic member 40 is made eccentric toward the ink groove 31, it contacts the inward protrusion 32 without contacting the ink groove 31. Accordingly, even if the ink grooves 31 are designed to wider than a diameter of the biasing portion 41, the biasing portion 41 is not stuck in the ink grooves 31.

Figure 9:
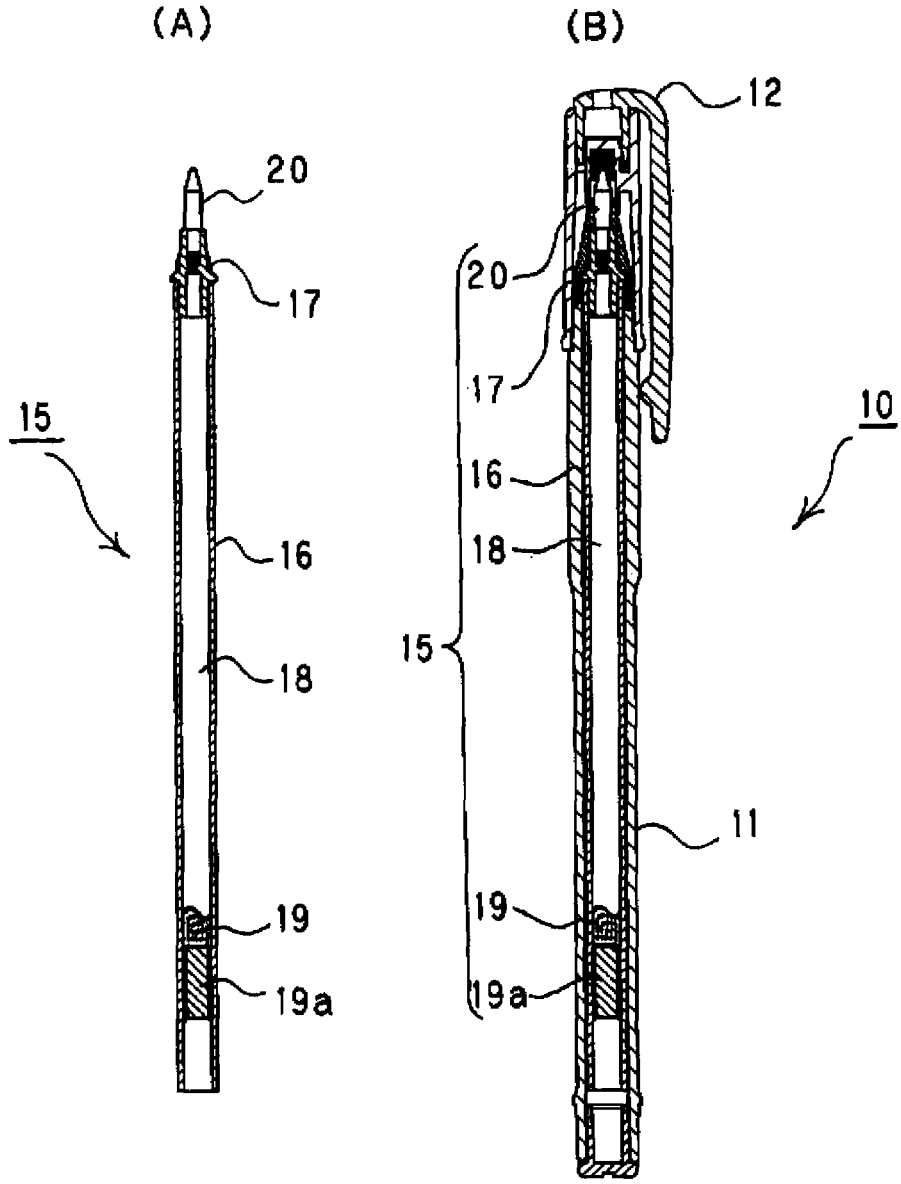
FIG. 9 A front cross sectional view of a ballpoint pen refill on which the ballpoint pen tip according to the present invention is mounted (A) and a front cross sectional view of a ballpoint pen in which the ballpoint pen refill is mounted (B).

The ballpoint pen tip 20 is, as shown in FIG. 9(A), mounted on an ink storage tube 16, which stores an ink 18, via the joint 17 so as to provide a ballpoint pen refill 15. Note that an ink following body 19 of a grease form for preventing backflow from a tail end of the ink 18 is filled at a rear end of the ink 18 and a float 19*a* whose gravity is equalized is stored therein in order to enhance its followability. The ballpoint pen refill 15 is accommodated inside a shaft tube 11 of a ballpoint pen 10 which is provided with a cap 12 as shown in FIG. 9(B).

The following inks can be used for the ballpoint pen refill 15 as shown in FIG. 9(A).

For instance, an ink for ballpoint pen containing at least an aluminum powder pigment, water and a thickener can be used.

A preferable aluminum powder pigment is characterized with an average particle diameter falling in a range of 0.5 to 5.0 μm under the consideration of stability and clogging resistance or other aspects of an ink for use in writing instruments. Moreover, a rust prevention process is preferably applied to the surface of an aluminum powder pigment in order to prevent oxidization in the water system. An aluminum powder pigment may be mixed with mixed components without processing or may also be used in a paste form by wetting with a hydrocarbon solvent such as mineral turpentine in advance. When it is used in a paste form, a commercial aluminum paste which is water dispersible can be used. Preferably used commercial products include 1500 MA which is a product manufactured by Toyo Aluminium K.K., WB1130 which is a product of the same, AW-808 as a trade name manufactured by Asahi Kasei Metals Corp., F500SIW as a trade name manufactured by Showa Aluminum Powder K.K., STAPAHydrolac-W8n. and STAPAHydrolac-WH8n.1. as trade names manufactured by ECKART. An aluminum powder pigment is arranged on the surface of a paint film to play a role of providing metallic luster of a metallic color.

Water is used as a main solvent and total pH of an ink is preferably set to about 7.

A thickener, which is combined in the present invention and used for suppressing precipitation of an aluminum powder pigment and providing appropriate fluidity as an ink for writing instrument, preferably provides a shear-thinning property. Concrete examples of the thickeners include: seed polysaccharides such as guar gum, locust bean gum, galactomannan, pectin and derivatives thereof, psyllium seed gum and tamarind gum, all of which are the examples as natural polysaccharides; xanthan gum, rheozan gum, rhamsan gum, welan gum and gellan gum, all of which are the examples derived from microorganisms; carrageenan and alginic acid and derivatives thereof, all of which are the examples as seaweed polysaccharides; resin polysaccharides such as tragacanth gum and cellulose or derivatives thereof; and polyacrylic acid and crosslinked copolymer thereof, polyvinyl alcohol, polyvinylpyrrolidone and derivatives thereof, and polyvinyl methyl ether and derivatives thereof, all of which are the examples as synthetic polymers.

In addition to the above examples, it is possible to appropriately add agents as needed such as water-soluble organic solvents, sequestering agents, pH adjusting agents, dispersion aids, fixing agents, surfactants, antiseptics, antibacterial agents, rust preventive agents, coloring pigments, coloring dyes, emulsions and latexes.

Moreover, by combination use of, as a coloring pigment other than the aluminum paste, known pigments which have been used for alcohol-based ink and glycol-based ink and dyes dissolved by the above solvents, a gold color or various kinds of other metallic colors can be exhibited.

In addition, as another example, a thermochromic ink may also be used, by which the color of the written traces can be changed with thermoplastic elastomer. The thermochromic ink is preferably a reversible thermochromic ink. The reversible thermochromic ink can be composed of individual use or concomitant use of various types of inks such as a thermal color extinction type whose color is extinguished by heating from a colored state, a color storage type whose colored state and a decolored state are interchangeably stored in a specific temperature range and a thermal coloring type whose color is developed by heating from a decolored state and returns to the decolored state by cooling from the colored state. An irreversible metachromasy ink may also be used. Moreover, a preferably used coloring material contained in the reversible thermochromic ink is a conventionally known reversible thermochromic microcapsule pigment in which a reversible thermochromic composition including at least three essential components of (i) an electron-donating coloring organic compound, (ii) an electron-accepting compound and (iii) a reaction medium determining the occurrence temperature of the color reaction of both of the compounds is encapsulated in microcapsules. The reversible thermochromic microcapsule pigment preferably has an average particle diameter falling in a range of 0.5 to 5.0 μm. If the average particle diameter is more than 0.5 μm, the outflow characteristics from a ballpoint pen tip and a capillary gap of a porous pen body are reduced. If the average particle diameter is less than 0.5 μm, it becomes difficult for the color development to exhibit high density. It is possible to blend the reversible thermochromic microcapsule pigment with a concentration of 2 to 50 wt. % (preferably 3 to 40 wt. %, or more preferably 4 to 30 wt. %) with respect to the total amount of the ink composition. If it is less than 2 wt. %, density of coloring will be insufficient. If it is more than 50 wt. %, ink outflow characteristics are reduced and result in hindrance of writability.

Furthermore, an eraser-erasable ink which allows erasure of written traces with erasers may also be used. The eraser-erasable ink needs to contain at least water, 3 to 30 wt. % of non-thermoplastic colored resin particles having an average particle diameter of 0.5 to 5.0 μm with respect to the total amount of the ink composition, and 0.1 to 10 wt. % of non-colored particles. The colored resin particles for use in the water-base ink according to the present invention are made of resin particles that are colored and non-thermoplastic with an average particle diameter of 0.5 to 5.0 μm such as, for example, colored resin particles in which a coloring agent made of a pigment is dispersed in resin particles, colored resin particles in which the surface of resin particles is coated with a coloring agent made of a pigment, and colored resin particles in which resin particles are dyed with a coloring agent made of a dye. In the present embodiment, colored resin particles may have either a hollow particle structure or a solid particle structure as long as being non-thermoplastic and satisfying the above average particle diameter. The shape of the colored resin particles may be, but not particularly limited to, spherical, polygon, flat, fibrous and other shapes. However, in light of demonstrating excellent eraser erasability, writability and chronic stability as an ink, it is preferable to use particles having intermolecular crosslinking such that a glass transition point is 150° C. or more near a pyrolysis temperature and further a melt flow index value is less than 0.1 without having an adhesion property and the particles are preferably colored resin fine particles of a spherical form with an average particle diameter of 0.5 to 5.0 μm.

An ink to be used is not particularly limited and any other inks can be used other than the aforementioned inks.

EXAMPLES

Examples of the present invention will be explained in comparison with comparative examples as follows. Each of the Examples according to the present invention and the Comparative Examples used the ink 18 composed as shown in a table 1 below and was filled in the ink storage tube 16 of the ballpoint pen refill 15 as shown in FIG. 9(A).

TABLE 1

| Component | Content (wt. %) |
|---|---|
| Aluminum paste: "AW-808" (trade name, manufactured by Asahi Kasei Metals Corp.) | 8 |
| Yellow pigment toner: Acrylic resin dispersed aqueous toner containing 15 wt. % of "Pigment Yellow" (trade name, manufactured by Sanyo Color Works, Ltd.) | 1 |
| Emulsion: "Joncryl J-450" (trade name, manufactured by BASF Japan Ltd.) | 5 |
| Thickener: 2 wt. % aqueous solution of "Reozan" (trade name, manufactured by Sansho Co., Ltd.) | 9 |
| pH adjusting agent: Triethanolamine | 0.5 |
| Lubricant: "Phosphanol RS-610" (trade name, manufactured by Toho Chemical Industry Co., Ltd.) | 0.2 |
| Rust preventive agent: Benzotriazole | 0.2 |
| Antiseptic: "Proxel XL-2" (trade name, manufactured by Arch Chemicals, Inc.) | 0.2 |

TABLE 1-continued

| Component | Content (wt. %) |
|---|---|
| Solvent: Propylene glycol | 20 |
| Solvent: Glycerine | 5 |
| Ion exchange water | The rest |

The ballpoint pen tips 20 according to the Examples of the present invention and the Comparative Examples were formed with processing dimensions as described in the following Tables 2 to 4 and mounted on the ballpoint pen refill 15 as shown in FIG. 9(A).

That is, in each of Example 1 and Comparative Examples 1-1 and 1-2 was used a writing ball 35 with a diameter of 0.38 mm. Moreover, in each of Example 2 and Comparative Examples 2-1 and 2-2 was used a writing ball 35 with a diameter of 0.50 mm. Furthermore, in each of Example 3 and Comparative Examples 3-1 and 3-2 was used a writing ball 35 with a diameter of 0.70 mm. Note that, other than the dimensions of the parts described in the Tables, identical processing dimensions and configurations were employed.

TABLE 2

| | Example 1 | Comparative Example 1-1 | Comparative Example 1-2 |
|---|---|---|---|
| Ball diameter (mm) | 0.38 | 0.38 | 0.38 |
| Inner diameter of ink guide hole (A) (mm) | 0.25 | 0.25 | 0.25 |
| Inner diameter of tip-end part of back hole (B) (mm) | 0.33 | 0.60 | 0.60 |
| Inner diameter of ball house (mm) | 0.41 | 0.41 | 0.41 |
| Diameter of circle circumscribing ink grooves (c) (mm) | 0.38 | 0.38 | 0.38 |
| Width of ink groove (mm) | 0.15 | 0.15 | 0.15 |
| Presence/absence of elastic member | Yes | Yes | No |
| Diameter of circle inscribing inward protrusion (D) (mm) | 0.23 | 0.23 | No |
| Wire diameter of elastic member (mm) | 0.12 | 0.12 | — |
| Ink outflow rate (mg/100 m) | 172 | 130 | 180 |

TABLE 3

| | Example 1 | Comparative Example 1-1 | Comparative Example 1-2 |
|---|---|---|---|
| Ball diameter (mm) | 0.50 | 0.50 | 0.50 |
| Inner diameter of ink guide hole (A) (mm) | 0.30 | 0.30 | 0.30 |
| Inner diameter of tip-end part of back hole (B) (mm) | 0.40 | 0.60 | 0.60 |
| Inner diameter of ball house (mm) | 0.53 | 0.53 | 0.53 |
| Diameter of circle circumscribing ink grooves (c) (mm) | 0.50 | 0.50 | 0.50 |
| Width of ink groove (mm) | 0.15 | 0.15 | 0.15 |
| Presence/absence of elastic member | Yes | Yes | No |
| Diameter of circle inscribing inward protrusion (D) (mm) | 0.28 | 0.28 | No |
| Wire diameter of elastic member (mm) | 0.12 | 0.12 | — |
| Ink outflow rate (mg/100 m) | 272 | 251 | 287 |

TABLE 4

| | Example 1 | Comparative Example 1-1 | Comparative Example 1-2 |
|---|---|---|---|
| Ball diameter (mm) | 0.70 | 0.70 | 0.70 |
| Inner diameter of ink guide hole (A) (mm) | 0.42 | 0.42 | 0.42 |
| Inner diameter of tip-end part of back hole (B) (mm) | 0.55 | 0.80 | 0.80 |
| Inner diameter of ball house (mm) | 0.73 | 0.73 | 0.73 |
| Diameter of circle circumscribing ink grooves (c) (mm) | 0.70 | 0.70 | 0.70 |
| Width of ink groove (mm) | 0.22 | 0.22 | 0.22 |
| Presence/absence of elastic member | Yes | Yes | No |
| Diameter of circle inscribing inward protrusion (D) (mm) | 0.40 | 0.40 | No |
| Wire diameter of elastic member (mm) | 0.12 | 0.12 | — |
| Ink outflow rate (mg/100 m) | 502 | 396 | 471 |

Note that Comparative Examples 1-2, 2-2 and 3-2 did not have the elastic member 40 and their ink grooves 31 completely penetrated to the back hole 28 without forming the inward protrusions 32. This structure is expressed as "No" in the Tables.

Moreover, regarding the inner diameter B of the tip-end part of each back hole, B is less than C in each of Examples whereas B is more than C in each of Comparative Examples.

The ballpoint pen refill 15, on which each of the ballpoint pen tips 20 according to Examples and Comparative Examples was mounted, was mounted on the ballpoint pen 10 as shown in FIG. 9(B) and a writing test was carried out as shown below.

That is, an ink outflow rate for the initial 100 m was measured by a writing tester according to the JIS standard S6039 in writing on a writing paper according to the ISO standard (14145-1) under such conditions that a writing load was 0.98N, a writing speed was 4.5 m/min and a writing angle was 60 degrees with the presence of pen rotation, in addition to further determine the quality of a written trace by visual observation.

The results were as shown in the above Tables 2 to 4, wherein ink outflow rates shown in Examples 1, 2 and 3 provided with the inward protrusions 32 were more than those of Comparative Examples 1-1, 2-1 and 3-1, and were not so much different from those of Comparative Examples 1-2, 2-2 and 3-2 in which the elastic members 40 were not provided and therefore did not prevent an ink outflow, respectively. Note that a faint written trace was observed in each of Comparative Examples 1-1, 2-1 and 3-1 and an ink drop was also observed in each of Comparative Examples 1-2, 2-2 and 3-2, whereas excellent quality was shown in each of Examples 1, 2 and 3 that neither faint written trace nor an ink drop was observed.

That is, the elastic member 40 kept an appropriate position in each of Examples 1, 2 and 3, whereby a faint written trace as observed in each of Comparative Examples 1-1, 2-1 and 3-1 did not occur and an ink drop was prevented while maintaining an equivalent ink flow rate to each of Comparative Examples 1-2, 2-2 and 3-2.

INDUSTRIAL APPLICABILITY

The present invention can be used for a ballpoint pen which employs an ink with a high shear-thinning property and an ink with poor fluidity due to inclusion of particles whose diameter is relatively large such as metal particles and pigment fine particles.

The invention claimed is:

1. A ballpoint pen tip comprising:

a writing ball, a holder holding the writing ball at a tip-end thereof, a tapered portion formed to be tapered in a tip-end part of an outer periphery of the holder, a narrowed portion formed to hold the writing ball by a tip-end of the tapered portion being deformed plastically inward, a ball house formed as an inner space of the holder at the tapered portion in which the writing ball is inserted, a back hole formed as an inner space of the holder extending forward from a rear end of the holder to a vicinity of the ball house, an ink guide hole formed as inner space of the holder connecting the back hole and the ball house, a plurality of ink grooves respectively formed as grooves penetrating from the ball house to a tip-end part of the back hole, the plurality of ink grooves being distributed at equal intervals in a radial manner at a plurality of positions around the ink guide hole with respect to an axial center of the ink guide hole, an elastic member biasing the writing ball forward being inserted in the back hole, a biasing portion as a tip-end part of the elastic member extending forward, passing through the ink guide hole, contacting a rear-end of the writing ball and biasing it forward, and a plurality of inward protrusions protruding inward being respectively formed at positions in contact with rear-ends of the ink grooves in the tip-end part of the back hole, the plurality of inward protrusions being arranged to respectively correspond to the plurality of the ink grooves, and the plurality of inward protrusions being distributed at equal intervals around the ink guide hole with respect to the axial center of the ink guide hole in the same manner as the plurality of ink grooves;

when an inner diameter of the ink guide hole being A, an inner diameter of the tip-end part of the back hole being B, a diameter of a circle circumscribing the ink grooves being C, and a diameter of a circle inscribing the inward protrusions being D, the relationships of $A<B<C$ and $D<B$ being satisfied.

2. The ballpoint pen tip according to claim 1, wherein the inward protrusions are formed by using deformed portions generated when the ink grooves are formed.

3. A ballpoint pen refill comprising the ballpoint pen tip according to claim 1 or 2.

4. A ballpoint pen comprising the ballpoint pen tip according to claim 1 or 2.

* * * * *